United States Patent [19]

Maguina-Larco

[11] Patent Number: 4,899,830

[45] Date of Patent: Feb. 13, 1990

[54] CUTTING TOOTH ASSEMBLY FOR HEAVY DUTY EARTH WORKING MACHINES

[76] Inventor: Alfredo Maguina-Larco, Catalino Miranda Av. No. 600, Surco, Peru

[21] Appl. No.: 359,515

[22] Filed: Jun. 1, 1989

Related U.S. Application Data

[63] Continuation-in-part of Ser. No. 53,101, May 21, 1987, abandoned.

[51] Int. Cl.[4] ..... E02F 5/32; E02F 9/28; A01B 13/08

[52] U.S. Cl. ..... 172/699; 172/737; 172/751; 37/142 R

[58] Field of Search ..... 172/699, 736, 737, 749, 172/751, 772; 37/142 R, 142 A, 141 T

[56] References Cited

U.S. PATENT DOCUMENTS

| | | | |
|---|---|---|---|
| 3,084 | 3/1819 | Harris | 172/737 |
| 183,907 | 10/1876 | Cook | 172/737 |
| 819,390 | 5/1906 | Warren | 172/699 |
| 2,148,925 | 2/1939 | Bochy | 37/142 R |
| 2,222,071 | 11/1940 | Gustafson | 172/751 |
| 2,940,192 | 6/1960 | Lattner | 37/142 R |
| 3,550,691 | 12/1970 | Davies | 172/699 |
| 3,750,761 | 8/1973 | Smith | 172/699 |
| 4,576,239 | 3/1986 | Launder | 172/751 |

*Primary Examiner*—Richard J. Johnson

*Attorney, Agent, or Firm*—Abelman Frayne Rezac & Schwab

[57] ABSTRACT

A cutting tooth assembly for heavy duty earth working machines has a replaceable cutting point comprised of a length of metal bar of constant transverse cross-section, which is frictionally held on a shank by a reusable holding clamp and which is repositionable on the shank. A used length of the metal bar is welded to an unused length of metal bar or to another used length of metal bar, thus permitting the entire length of the cutting point material to be utilized, thus limiting discarded scrap to a minimum and reducing operation costs.

5 Claims, 4 Drawing Sheets

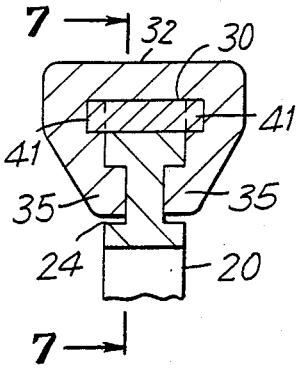
FIG. 6
FIG. 7
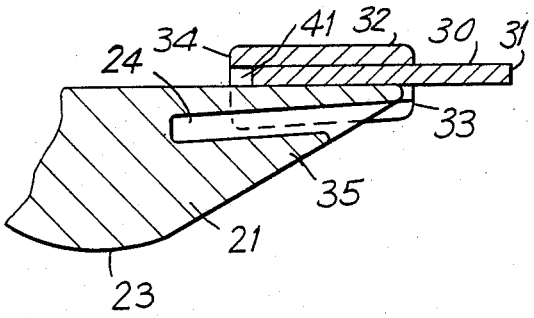
FIG. 9
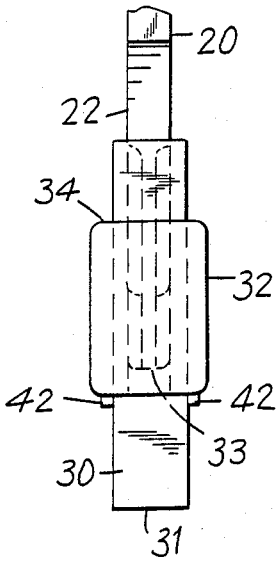
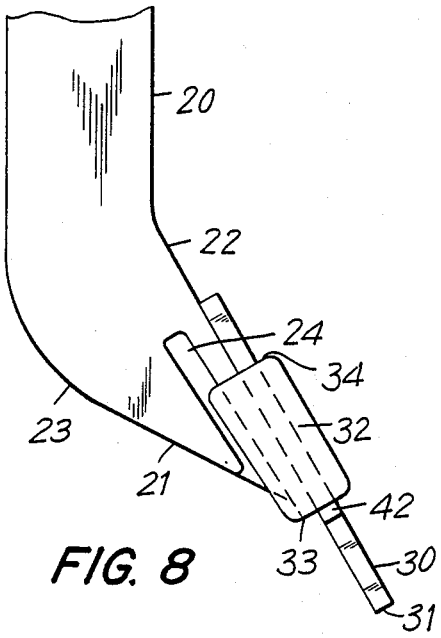
FIG. 8
FIG. 10
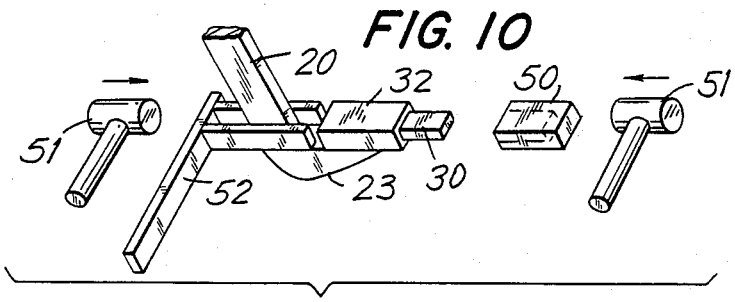

CUTTING TOOTH ASSEMBLY FOR HEAVY DUTY EARTH WORKING MACHINES

This is a continuation-in-part of Ser. No. 07/053,101, filed May 21, 1987, now abandoned.

FIELD OF THE INVENTION

This invention relates to a cutting tooth assembly for use in ground cutting machines, such as earth moving machines, agricultural machines, or mining machines, and such machines as used in the construction industry. Typical of such machines are scarifiers, rippers, backdiggers, power shovels and rotary cutting machines.

BACKGROUND OF THE INVENTION

Ground cutting machines of the type referred to commonly operate in extremely hostile environments, and ones in which the cutting points are subjected to enormous mechanical stresses, and, rapid wear by abrasion.

It is, therefore, necessary to form the cutting points as readily replaceable members to permit their replacement at the time the point has become worn down to such an extent that it is no longer efficient as a cutting tool.

The cutting points themselves must of necessity be formed from an extremely hard material that is resistant to wear, and also one which is highly resistant to fatigue fracture in order to provide for an extended life of the points when in use.

The cutting points themselves are thus expensive to manufacture, and, under most circumstances have only a relatively short useful life before the remaining portion of the point must be discarded as scrap material.

For this reason, it has been common practice to support the cutting points on shanks each formed to hold and secure a cutting point. The cutting points are removable and replaceable at the time they have become worn down to an extent that they are of no further use.

One form of shank as disclosed in Smith et al. U.S. Pat. No. 3,750,761, includes a holder into which the cutting point is inserted and then secured in position by means of bolts. Such an arrangement suffers from the disadvantages that the bolts work loose under the sever impacts and vibrations encountered by the tool when in use. Additionally, the heads of the bolts become worn down making them difficult or impossible to remove by a wrench.

Another form of shank disclosed in Gustafson, U.S. Pat. No. 2,222,071, has a planar surface and grooves in its side surfaces that diverge from the planar surface from the open ends of the grooves. The cutting point has a socket of corresponding form, and has side flanges that extend into the grooves of the holder, the side flanges being correspondingly inclined for them to be received within the grooves. In this manner, axial forces which are exerted on the cutting point when in use act to drive the cutting point further into clamping engagement by wedging it further into is associated holder.

However this latter arrangement carries with it the great disadvantage that the extremely expensive cutting point must be manufactured by drop-forging from an expensive material that has compromising characteristics between the extremely high hardness required for the cutting tip of the point and the ductility required for the socket portion. Further, the cutting point must be discarded in its entirety once it has become damaged or worn down, this including the socket portion of the point i.e., a major amount of the expensive material employed in the formation of the cutting point has to be discarded as scrap.

A development of this latter concept is shown in Launder U.S. Pat. No. 4,567,239, in which the relative amount of material to be discarded upon replacement of a cutting points is materially reduced. This is accomplished by forming the point separately from the holding portion of the point.

The holding portion is formed in substantially the same shape as in the prior construction, but, entirely separately from the cutting point. The holding portion is thus in the form of a clamp which is employed for holding the cutting point by wedged onto the supporting shank.

The cutting point is then formed separately with a shank portion of its own formed integrally with the cutting tip, the shank portion being received within the holding clamp and clamped directly onto the shank by the holding clamp.

This construction materially reduces the amount of material that must be discarded on breakage or wearing down of the cutting point, to the cutting point of the tooth and its associated integral shank portion. The holding clamp is not discarded, but instead is available for holding a replacement cutting point, the holding clamp itself being far less subject to wear by abrasion than isthe cutting point itself, and thus lasting for several uses.

Nevertheless, this improvement in the art still goes only part way in meeting the problem, in that the worn cutting point must be discarded in its entirety as scrap, this including the integral shank formed on the cutting point. Clearly, it would be a major advantage if the need to discard a worn cutting point could be eliminated in its entirety. Also, it would be a major advantage if the cutting point could be formed of less expensive material and in a less expensive manner than by drop forging.

Smith et al. U.S. Pat. No. 3750761 teaches a cutting point that can be formed other than by drop forging or casting. Smith teaches the formation of the cutting point of the tooth from a continuous length of bar stock, which can be produced by rolling or drawing, or extrusion. However, Smith's teachings are of attachment of his cutting point to the main shank using the old technology of employing securing bolts, and which is encumbered with all of the disadvantages of the known technology.

SUMMARY OF THE INVENTION

It is an object of this invention to provide a cutting tooth assembly which provides all of the advantages of the known assemblies, while at the same time avoiding all of the disadvantages thereof.

According to the present invention, the cutting tooth assembly includes a main shank, and a channel-type holding clamp secured to the main shank by a frictional wedging grip. The holding clamp is formed to accept and secure a cutting point of a cutting tooth formed from continuous steel bar of constant transverse cross-section.

The holding clamp and the main shank are formed so as to maintain the frictional wedging grip of the holding clamp in the presence of axial forces exerted on the cutting point.

Axial forces present while the cutting torch is in service, act in the same direction of those required for fastening the tooth assembly. Those forces actually may drive the cutting point along with the holding clamp further into clamping wedging engagement with the holding shank, effectively preventing any loosening of the cutting tooth assembly.

In some application such as machines with rotational cutting drums, there are also present vibrational forces acting in a direction opposite to those required for fastening the tooth assembly, and which can result in loosening of the cutting tooth assembly. To prevent this from happening, stops are attached to the bar stock, the stops being positioned for them to engage the end of the holding clamp and force the holding clamp further into frictional wedging grip with the main shank during use of the cutting tooth.

For applications involving extremely high vibration level, stops can be provided in the holder. These stops provide an abutment for the cutting point preventing the cutting point from moving further backwards when subjected to axial forces, those forces acting to drive the cutting point along with the holding clamp further into clamping wedging engagement with the holding shank, thus effectively preventing any loosening of the cutting tooth assembly.

In the event that the cutting point has become worn down to an extent requiring replacement of the cutting point, all that is required is to loosen off the holding clamp, extend the cutting point to the desired extent, and then retighten the holding clamp. This permits all but a minor length of the cutting point to be successively used. The remaining minor length can then be butt welded to another remaining minor length, and further used in exactly the same manner. If the cutting point has been provided with side stops, further side stops can be added by tack welding each time the cutting point is extended.

DESCRIPTION OF THE DRAWINGS

The invention will now be described with reference to the preferred embodiment illustrated in the accompanying drawings, in which:

FIG. 6 is a cross-section taken on the line 6—6 of FIG. 5;

FIG. 7 is a cross-section taken on the line 7—7 in FIG. 6;

FIG. 8 is a side elevational view corresponding with FIG. 2, but showing side stops attached to the cutting point;

FIG. 9 is a front elevation of FIG. 8;

FIG. 10 is a perspective view of the cutting tooth assembly illustrating the manner of securing or releasing a cutting point relative to a shank;

DESCRIPTION OF THE PREFERRED EMBODIMENTS

Figure 1:
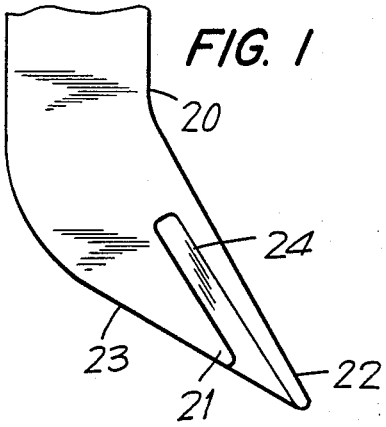
FIG. 1 is a side elevational view of a shank.
Figure 2:
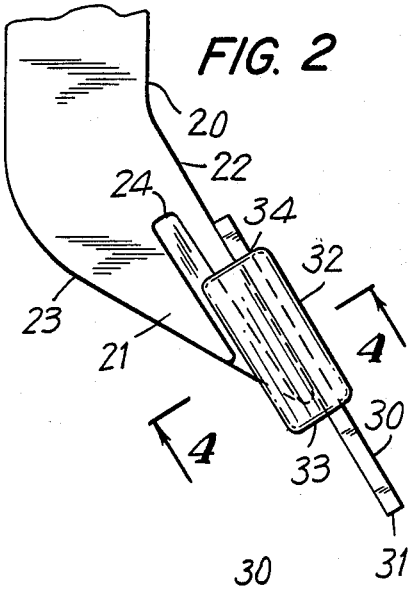
FIG. 2 is a side elevational view of the cutting tooth assembly of my invention mounted on a shank.
Figure 3:
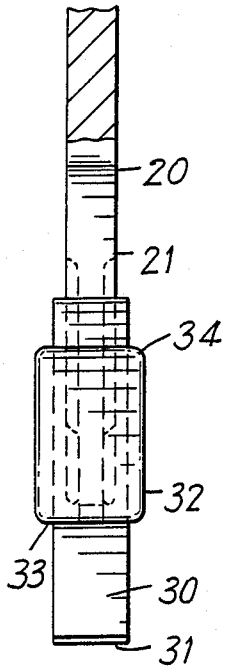
FIG. 3 is a front view of FIG. 2.
Figure 4:
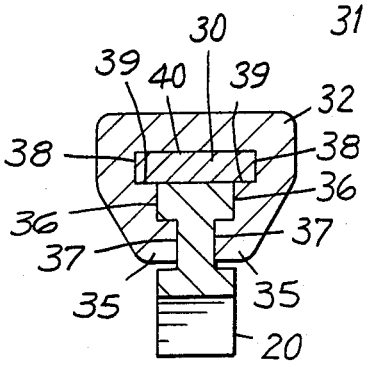
FIG. 4 is a cross-section taken on the line 4—4 in FIG. 2.

Referring firstly to FIGS. 1, 2, 3 and 4 the cutting tooth assembly of the present invention comprises a shank 20 of conventional form formed of very hard steel, which is to be attached to a machine by dowels or by any other convenient manner, as is conventional in the art.

The shank 20 has a snout 21 which provides an upwardly inclined planar upper surface 22 destined to receive the cutting point, and has a bottom surface 23 which also is inclined upwardly towards the free end of the shank, such that the bottom of the edge 23 lies within the radius of movement of a cutting point 30. As is apparent from FIG. 4, the width of the cutting point 30 is greater than the thickness of the shank 20.

The snout 21 is provided on its opposite sides with axially straight grooves 24, which diverge from the planar face 22 from the open end of the grooves, at a small angle of, for example, 4° or less.

Planar surface 22 and grooves 24 are smooth surfaces providing for relatively low friction coefficient.

The cutting point 30 has a forward cutting edge 31, and is in the form of a standard flat bar of steel. Preferably the steel has a hardness of 50 Rockwell C. and a resistance of bending of 220 kPSI so that it can stand up to the hard use to which it is to be subjected, and for it to resist wear and fatigue under the extremely high stresses imposed on the cutting point during use.

One major face of the cutting point 30 is positioned directly on the planar face 22, and is secured in that position by a holding clamp 32. The holding clamp 32 is of U-shaped configuration, and preferably is made of forged steel having an approximate hardness of 47–48 Rockwell C., thus providing the holding clamp 32 with greater ductility than that of the cutting point 30.

The holding clamp 32 has a front end 33 and a rear end 34, and tapers from its rear end 34 to its forward end 33, such that keys 35 at the open side of the U-shaped configuration diverge from the forward end 33 to the rearward end 34 of the holding clamp at the same angle as the divergence of the grooves 24 in the snout 21.

The holding clamp 32 includes axial surfaces 36 and 37 adapted to embrace the sides of the snout 21 to prevent the holding clamp from angling relative to the snout 21, and also includes planar surfaces 38, 39 and 40 adapted to receive and embrace the cutting point 30.

Surface 39 of the holding clamp is smoother than surface 40 in order to provide for a lower friction coefficient for the surface 39 than for the surface 40.

In order to assemble the cutting tooth assembly, the cutting point 30 is inserted into the holding clamp 32, and the holding clamp 32 is then positioned over the snout 21 of the shank 20, with its side flanges 35 positioned within the side grooves 24 of the snout. The cutting point 30 and the holding clamp 32 are then moved onto the snout 21, the flanges 35 of the holding clamp at this time progressively moving along the inclined grooves 24, to move the holding clamp 32 downwardly into clamping engagement with the cutting point 30 and in turn, to move the cutting point 30 into clamping engagement with the upper planar surface 22 of the snout.

Eventually, further movement of the holding clamp onto the snout will be prevented by frictonal engagement of the respective components with each other. At this point, and as is illustrated in FIG. 5, a locking tool 51 can be positioned over the end of the cutting point 30, and the holding clamp 32 can be given a sharp tap on its forward end 33 using a mallet 50 in order to secure the holding clamp 32 and the cutting point 30 securely on the snout 21.

It will be observed that any axial forces exerted on the free end 31 of the cutting point 30 will be acting in the same direction required to move the holding clamp 32 into greater frictional engagement with the snout 21.

Also, it will be observed that any impacts by stones and the like on the front end of the holding clamp 32 also acts to move the holding clamp into closer frictional engagement with the cutting point 30 and the snout 21.

Figure 5:
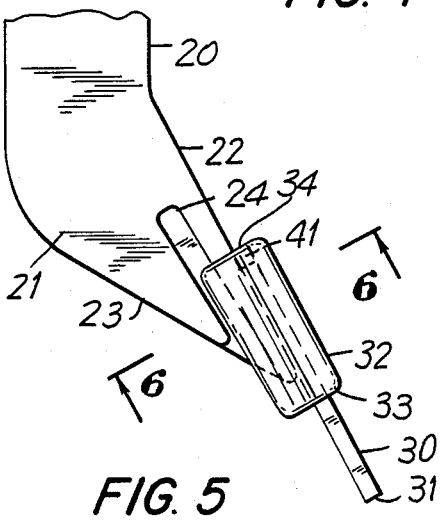
FIG. 5 is a side elevational view of an alternative cutting tooth assembly similar to the one shown in FIG. 2.

To release the holding clamp for adjustment or replacement of the cutting point 30, it is merely necessary for a sharp blow to be delivered to the rear end of the holding clamp 32, using the loosening or un-locking tool 52 illustrated in FIG. 5 and the mallet 51.

As will be observed, the cutting point 30 is of constant transverse cross-section throughout its length. The receiving channel in the holding clamp 32 also is of constant transverse cross-section throughout its length. Thus, prior to setting of the holding clamp 32 the cutting point 30 can be moved forwardly or rearwardly within the channel of the holding clamp 32 for it to be adjusted in position to the desired radius of its cutting movement.

Once the cutting point 30 has worn down to an extent requiring its extension, it can be extended merely by loosening the holding clamp 32, sliding the cutting point 30 forwardly and then re-tightening the holding clamp 32.

Eventually, there will be an insufficient length left of the cutting point 30 for it to be adequately clamped by the holding clamp 32. At this point, the remaining portion of the cutting point 30 can be removed from the holding clamp 32, and then butt-welded to another length of cutting point 30. In this manner, the used length of the cutting point 30 again is available for use, resulting in no waste material that must be discarded as scrap.

For applications in machines subject to extremely high vibration levels such as those with high speed rotary cutters, the frictional locking effect provided by the initial wedge tightening of locking clamp 32 may not be high enough to avoid slippage of the cutting point 30. Thus, extra locking pressure may be required while the cutting tooth is in use. For such applications, alternative embodiments of the invention as illustrated in FIGS. 5, 6, 7, 8 and 9 are employed.

In FIGS. 5, 6 and 7 the rear end of the holding clamp 32 is provided with abutments 41 which extend into the channel provided for the reception of the cutting point 30. In this embodiment, when the cutting point 30 is inserted in the holding clamp 32, its end abuts the abutments 41, which provide positive stops against further rearward movement of the cutting point 30 relative to the holding clamp 32.

Thus, in this embodiment, axial forces exerted on the cutting end 31 of the cutting point 30 will be transmitted directly to the stops 41 of the holding clamp 32, and will act to force the components of the entire assembly into closer frictional engagement with each other.

Alternatively, and as illustrated in FIGS. 8 and 9, side stops 42 can be attached to the lateral edges of the cutting point 30 for them to abut the holding clamp 32 at its forward end. At the time the cutting point 30 is extended for further use, then, further stops 42 can be welded to its side edges. The stops 42 when reaching the position of cutting edge 31 ultimately are consumed by abrasion of the cutting edge 31. Thus, they do not interfere with the welding of the end of an unused cutting point 30 to the unused end of a used cutting point.

Figure 13:
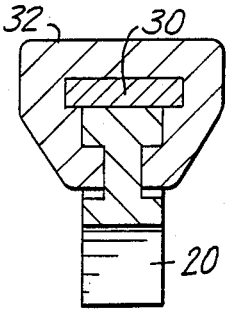
FIGS. 11, 12 and 13 show a variation of the shank of FIG. 1.
Figure 11:
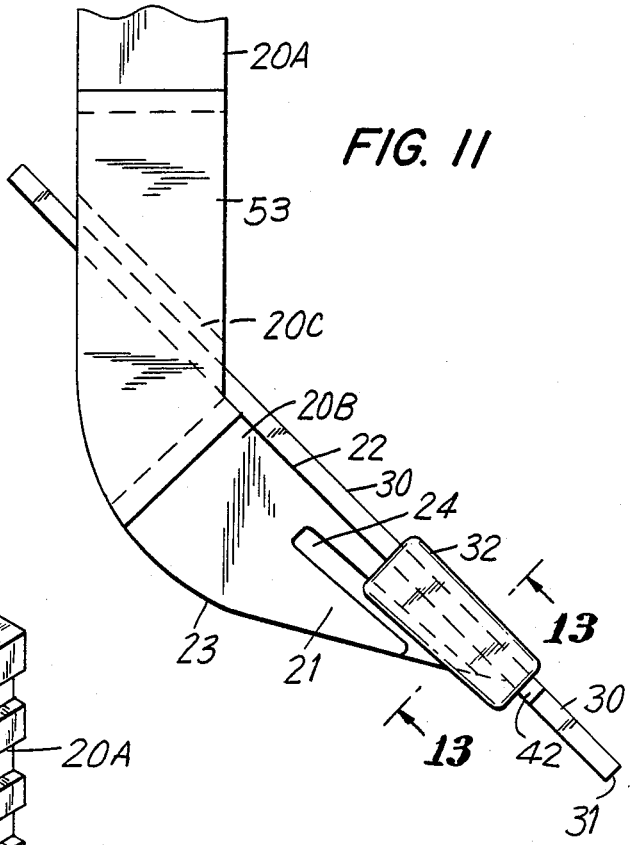
Figure 12:
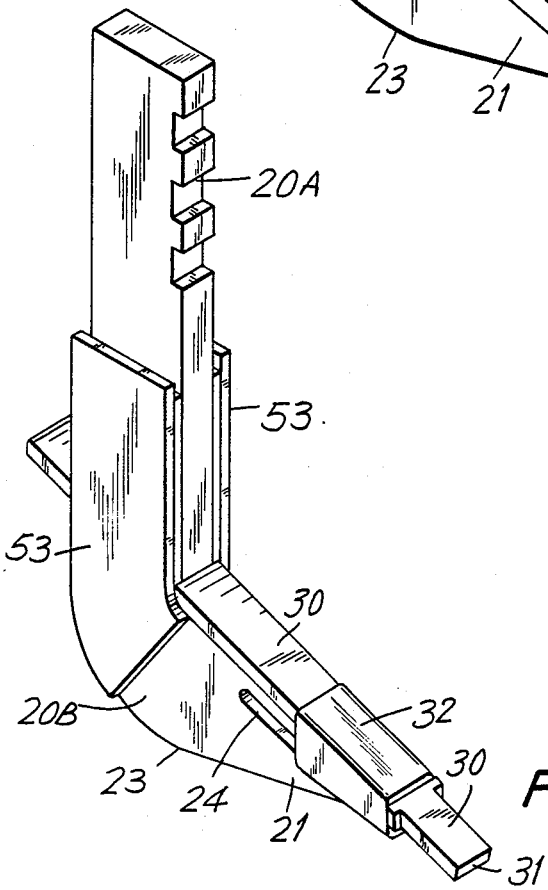

Referring now to FIGS. 11–13, an alternative construction of the preferred embodiment are FIGS. 1–5 is illustrated. In FIGS. 11–13, the same reference numerals have been used as those used in FIGS. 1–5 to denote members in common with FIGS. 1–5.

In FIGS. 11–13, as in FIGS. 1–5, the cutting tooth assembly includes a shank 20 having a snout 21 with an upwardly extending lower edge 23.

As is shown more clearly in FIGS. 11 and 12, the shank 20 is split into two sections 20A and 20B in a plane that includes the plane of the upper planar surface 22 of the snout 21. The respective shank portions 20A and 20B are interconnected with each other by side plates 53—53 which are welded to the respective shank portions 20A and 20B, and, which maintain the respective shank portions 20A and 20B held immovably in spaced relation at their adjacent end faces for them to define a slot 20C extending through the shank, and, through which a cutting point 30 of any axial length can extend in parallel face to face relation with the upper surface 22 of the snout 21.

In this manner, lengths of cutting point 30 considerably in excess of length of the cutting point 30 of FIGS. 1–5 can be inserted into the cutting tooth assembly, thus considerably prolonging the periods of time between the replacement of the cutting point, it merely being necessary to release the holding clamp 32, and then to slide a further length of the cutting point 30 forwardly into the required extended position in front of the holding clamp 32.

Figure 14:
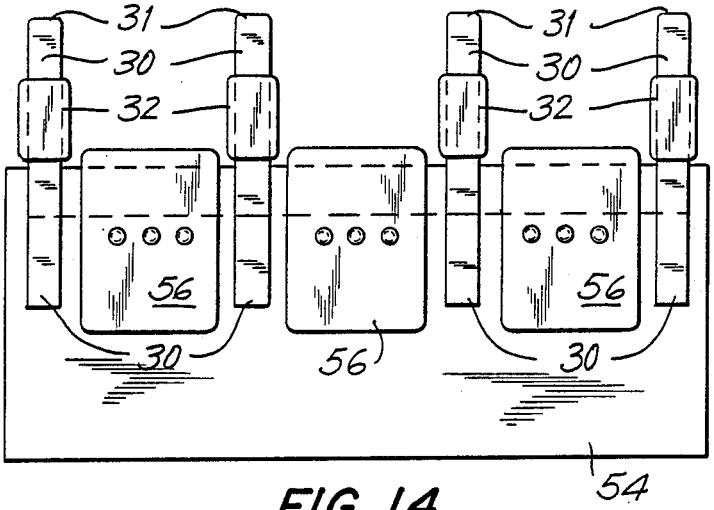
FIGS. 14, 15 and 16 show another alternative embodying multiple modified shanks of FIG. 1.
Figure 15:
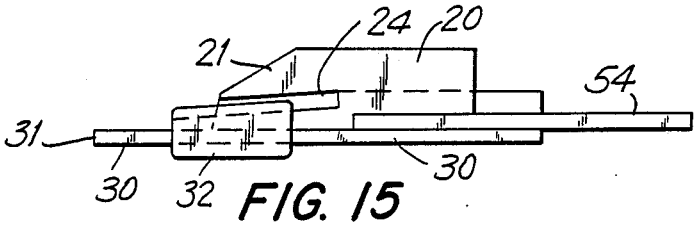
Figure 16:
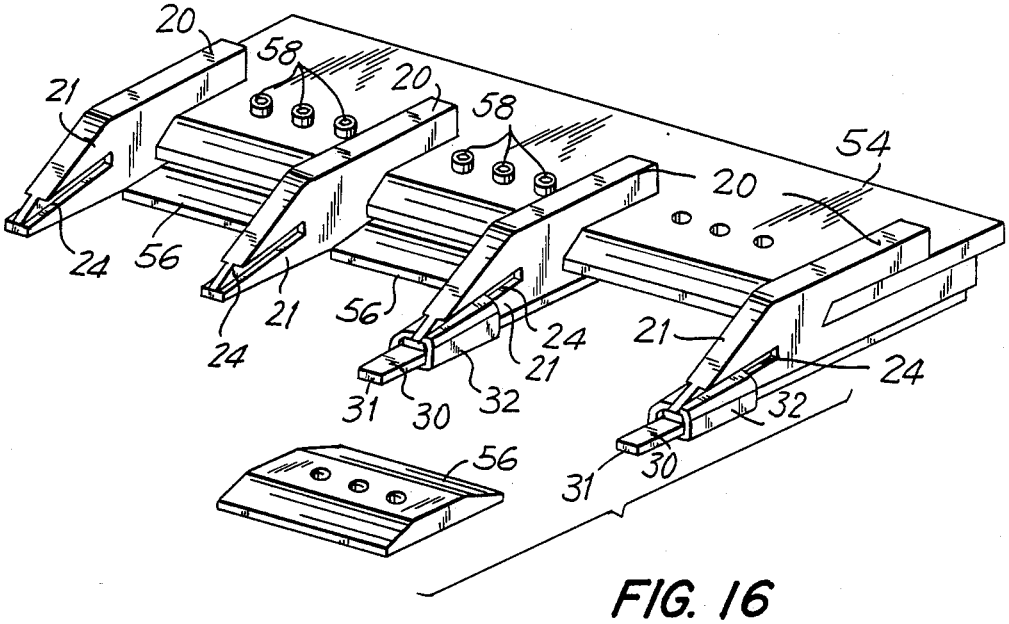

Referring now to FIGS. 14–16, in which again the same reference numerals are employed as those employed in the description of FIGS. 1–5, a modified form of cutting tooth assembly is shown which is specifically adapted to an earth levelling or planing machine.

In FIGS. 14–16, the shanks 20 are axially straight, such that they comprise, essentially, the snout portion only of the shank 20 of FIGS. 1–12. The shanks 20 each are welded or otherwise secured to a base plate 54 with the snouts 21 of the respective shanks 20 extending forwardly of a leading edge of the base plate 54. As in the embodiments previously described, the shanks 20 support cutting points 30 which are secured to the snouts 21 by holding clamps 32, exactly in the manner previously described. The configuration of FIGS. 14–16 being an inversion of the configuration of FIGS. 1–13, in that the cutting points are secured to a lower face of the associated snouts, the respective axially straight grooves 24 diverging upwardly from the lower surfaces of the snouts from the free ends of the snouts.

In exactly the same manner as described with reference to the previous Figures, a holding clamp 32 is positioned over the front of the snout, a cutting point 30 is inserted into the holding clamp, and then, the holding clamp is driven onto the snout 21 to immovably clamp the cutting point 30 onto the snout.

Conveniently, the spaces between the respective cutting points 31 can accommodate planing teeth 56, which can be attached directly to the base plate 54 by bolts 58. The planing teeth 56 are subject to less wear than the cutting points 30, in view of which they require to be replaced less frequently that is the case with the cutting points 30.

I claim:

1. A cutting tooth assembly for use in heavy duty earth working machines, comprising in combination:

a shank having a first portion for attachment to a driven member of said machine, and having a second snout portion providing a planar surface for the support of a cutting point;

said second portion including locking grooves extending at a minor angle of divergence relative to said planar surface from a free end of said snout;

a holding clamp having mutually presented flanges for reception in said locking grooves, said holding clamp having internal axially straight longitudinally extending clamping surfaces for sliding and clamping engagement with corresponding axially extending surfaces on a said cutting point; and, a cutting point comprised of an axially straight continuous length of bar stock of constant transverse cross-section and of a width greater than the thickness of said shank received within said clamping surfaces of said holding clamp, said cutting point being axially adjustable relative to said snout and said holding clamp prior to tightening down of said holding clamp to provide an earth working tool of a desired length extending forwardly of said snout, and being rigidly and immovably frictionally clamped to said snout in any selected position of axial adjustment of said cutting point upon forcing said holding clamp onto said snout;

said cutting point including axially short used length of cutting point, welded at the unused end thereof to an unused end of an axially longer said cutting point in series relation receivable in said holding clamp to permit complete utilization of said axially short used length of cutting point.

2. The cutting tooth assembly of claim 1, in which at least one stop member is secured to said cutting point at a position in advance of said holding clamp, said stop member extending radially of said cutting point into engagement with a frontal surface of said holding clamp, whereby, axial forces exerted on said cutting point are operative to force said holding clamp axially of said locking grooves in said snout to force said clamp into greater frictional clamping engagement with said cutting point.

3. The cutting tooth assembly of claim 2, in which said stop member is welded to an outer surface of said cutting point, successive stop members being weldable to said cutting point at the time said cutting point is further axially extended from said holding clamp.

4. The cutting tooth assembly of claim 1, including an aperture in said first portion of said shank permitting the passage therethrough of a said cutting point.

5. A cutting tooth assembly for use in heavy duty earth working machines, comprising in combination:

a shank having a first portion for attachment to a driven member of said machine and having a second snout portion providing a planar surface for the support of a cutting point;

said second portion including locking grooves extending at a minor angle of divergence relative to said planar surface from a free end of said snout;

a holding clamp having mutually presented flanges for reception in said locking grooves, said holding clamp having internal axially straight longitudinally extending clamping surfaces for sliding and clamping engagement with corresponding axially extending surfaces on a said cutting point, said axially straight longitudinally extending clamping surfaces including end stops for limiting the extent to which a said cutting point can be inserted into said holding clamp; and, a cutting point comprised of an axially straight continuous length of bar stock of constant transverse cross-section and of a width greater than the thickness of said shank received within said holding clamp and engaged with said end stop members, whereby forces exerted axially of said cutting point will force said holding clamp into greater frictional engagement with said cutting point;

an axially short unused length of cutting point being welded at the unused end thereof to an unused end of an axially longer said cutting point in series relation to permit complete utilization of said axially short used length of cutting point.

* * * * *